US005747203A

United States Patent [19]

Nozomi et al.

[11] Patent Number: 5,747,203

[45] Date of Patent: May 5, 1998

[54] ELECTROPHOTOGRAPHIC PHOTORECEPTOR HAVING CHARGE GENERATING LAYER WITH SPECIFIC POLYESTER

[75] Inventors: Mamoru Nozomi, Odawara, Japan; Osamu Murakami, Chesapeake, Va.; Masahiro Fuse, Odawara; Makoto Furuune, Yokohama, both of Japan

[73] Assignee: Mitsubishi Chemical Corporation, Tokyo, Japan

[21] Appl. No.: 712,285

[22] Filed: Sep. 11, 1996

[30] Foreign Application Priority Data

Sep. 12, 1995 [JP] Japan ..... 7-234242

[51] Int. Cl.[6] ..... G03G 5/05

[52] U.S. Cl. ..... 430/58; 430/96

[58] Field of Search ..... 430/96, 58

[56] References Cited

U.S. PATENT DOCUMENTS

| | | | |
|---|---|---|---|
| 3,615,406 | 10/1971 | Merrill | 430/96 |
| 3,703,372 | 11/1972 | Merrill | 430/96 |
| 3,709,684 | 1/1973 | Feltzin | 430/96 |
| 3,865,789 | 2/1975 | Wyhof | 430/96 |
| 3,865,869 | 2/1975 | Kuehn et al. | 430/96 |
| 3,905,813 | 9/1975 | Wyhof . | |
| 4,772,526 | 9/1988 | Kan et al. | 430/96 |
| 5,223,361 | 6/1993 | Mishra et al. . | |
| 5,378,567 | 1/1995 | Nozomi et al. . | |

FOREIGN PATENT DOCUMENTS

| | | |
|---|---|---|
| 0 312 469 | 4/1989 | European Pat. Off. . |
| 2 022 016 | 7/1970 | France . |
| A-63-243947 | 10/1988 | Japan . |

OTHER PUBLICATIONS

Patent Abstracts of Japan, vol. 12, No. 114, (P-688), Apr. 12, 1988, JP-A-62 244056, Oct. 24, 1987.

Patent Abstracts of Japan, vol. 12, No. 151, (P-699), May 11, 1988, JP-A-62 267748, Nov. 20, 1987.

Patent Abstracts of Japan, vol. 18, No. 405, (P-1778), Jul. 28, 1994, JP-A-6 118678, Apr. 28, 1994.

Borsenbrger, Paul M. & David S. Weiss. Organic Photoreceptors for Imaging Systems. New York: Marcel-Dekker, Inc. pp. 289-292, 301, 306-309, 338-339, 356-361, 1993.

*Primary Examiner*—Christopher D. Rodee

*Attorney, Agent, or Firm*—Oblon, Spivak, McClelland, Maier & Neustadt, P.C.

[57] ABSTRACT

An electrophotographic photoreceptor comprising an electrically conductive support and at least a carrier generation layer and a carrier transport layer formed on the substrate, wherein said carrier generation layer contains a polyester resin having a repeating structural unit of the following formula (I):

(I)

wherein each of $R^1$ and $R^2$ is an alkylene group which may have a substituent; each of $R^3$ and $R^4$ is a hydrogen atom, an alkyl group which may have a substituent or an aryl group which may have a substituent, or $R^3$ and $R^4$ may together form a ring; Ar is an arylene group which may have a substituent; each of $Ar^1$ and $Ar^2$ is a phenylene group which may have a substituent; and each of m and n is from 0 to 10, provided that m and n are not simultaneously 0.

11 Claims, 1 Drawing Sheet

ELECTROPHOTOGRAPHIC PHOTORECEPTOR HAVING CHARGE GENERATING LAYER WITH SPECIFIC POLYESTER

The present invention relates to an electrophotographic photoreceptor. More particularly, it relates to an electrophotographic photoreceptor useful for e.g. copying machines or various printers, which is an organic lamination type electrophotographic photoreceptor having a novel binder polymer incorporated in the carrier generation layer.

Electrophotography provides an image of high quality instantaneously and thus has been widely used in recent years not only in the field of copying machines but also in the field of various printers. As an electrophotographic photoreceptor which is essential for the electrophotography, an electrophotographic photoreceptor has recently been developed wherein an organic photoconductor having advantages such that it is pollution free and it can readily be prepared and formed into a film, is used instead of a conventional inorganic photoconductor such as selenium, an arsenic-selenium alloy, cadmium sulfide or zinc oxide. Especially a so-called lamination type electrophotographic photoreceptor having a carrier generation layer and a carrier transport layer laminated on a substrate is now the most popular subject in the research for an organic electrophotographic photoreceptor.

Such a lamination type electrophotographic photoreceptor is usually prepared by coating or impregnating, to an electrically conductive substrate, a dispersion prepared by adding a dispersant and a binder polymer such as polyvinyl butyral, a polyester, a polycarbonate or a polystyrene to finely pulverized carrier generation material, followed by drying to form a carrier generation layer, and further forming a carrier transport layer thereon.

The lamination type electrophotographic photoreceptor has various advantages such that it is possible to realize a high performance photoreceptor by a combination of a highly efficient carrier generation material and a highly efficient carrier transport material, the selective ranges of the materials are wide, the level of its safety is high, and its preparation is easy. On the other hand, it has a certain problem in its durability, and when it is used repeatedly, its electrical properties deteriorate, such that the electrification potential decreases, the residual potential accumulates, and the sensitivity changes.

Accordingly, researches for development of photoconductive compounds such as carrier generation materials and carrier transport media, and sensitizers have been actively made to improve the performance including the durability. As compared with such researches, a research on a binder polymer has not been so active, and commercially available common polymers are used as binders in the majority of organic photoreceptors which are practically employed. Such commercially available binder polymers do not necessarily provide adequate performance for photoconductive compounds. For example, for a photoreceptor of the type having photoconductive particles dispersed therein, it is first necessary to use a binder polymer excellent in the dispersion stability of the particles. However, polyvinyl butyral which is excellent in the dispersion stability, has a difficulty in separation and injection of electric charge and has a problem such as a decrease in the sensitivity or an increase in the residual potential. On the other hand, a polyester, a polycarbonate or a polystyrene which is efficient in separation and injection of electric charge, is rather poor in the dispersion stability of particles, and a majority of particles tend to thereby agglomerate. Further, if treatment for dispersion stability is carried out, there will be a problem such as deterioration of electrical properties such as sensitivity and residual potential.

Accordingly, a binder polymer excellent in both the dispersion stability and the electrical properties has not yet been found.

Japanese Unexamined Patent Publication No. 243947/1991 discloses that a polyester resin is used for the carrier generation layer, but teaches nothing about use of a polyester resin having a specific structure of the present invention, i.e. a polyester resin of the formula (I).

The present inventors have conducted extensive studies to solve the above problems and as a result, have found that a polyvinyl acetal resin having a certain specific structural unit is excellent in both the dispersion stability and the electrical properties as a binder polymer to be used for the carrier generation layer of a lamination type electrophotographic photoreceptor, particularly in the effects for improving the sensitivity. The present invention has been accomplished on the basis of this discovery.

Namely, it is an object of the present invention to provides a high performance electrophotographic photoreceptor excellent in the sensitivity and durability, industrially advantageously.

Thus, such an object of the present invention can readily be accomplished by an electrophotographic photoreceptor comprising an electrically conductive substrate and at least a carrier generation layer and a carrier transport layer formed on the substrate, wherein said carrier generation layer contains a polyester resin having a repeating structural unit of the following formula (I):

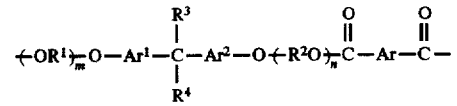

(I)

wherein each of $R^1$ and $R^2$ is an alkylene group which may have a substituent; each of $R^3$ and $R^4$ is a hydrogen atom, an alkyl group which may have a substituent or an aryl group which may have a substituent, or $R^3$ and $R^4$ may together form a ring; Ar is an arylene group which may have a substituent; each of $Ar^1$ and $Ar^2$ is a phenylene group which may have a substituent; and each of m and n is from 0 to 10, provided that m and n are not simultaneously 0.

BRIEF DESCRIPTION OF THE DRAWING

In the accompanying drawing.

Figure 1:
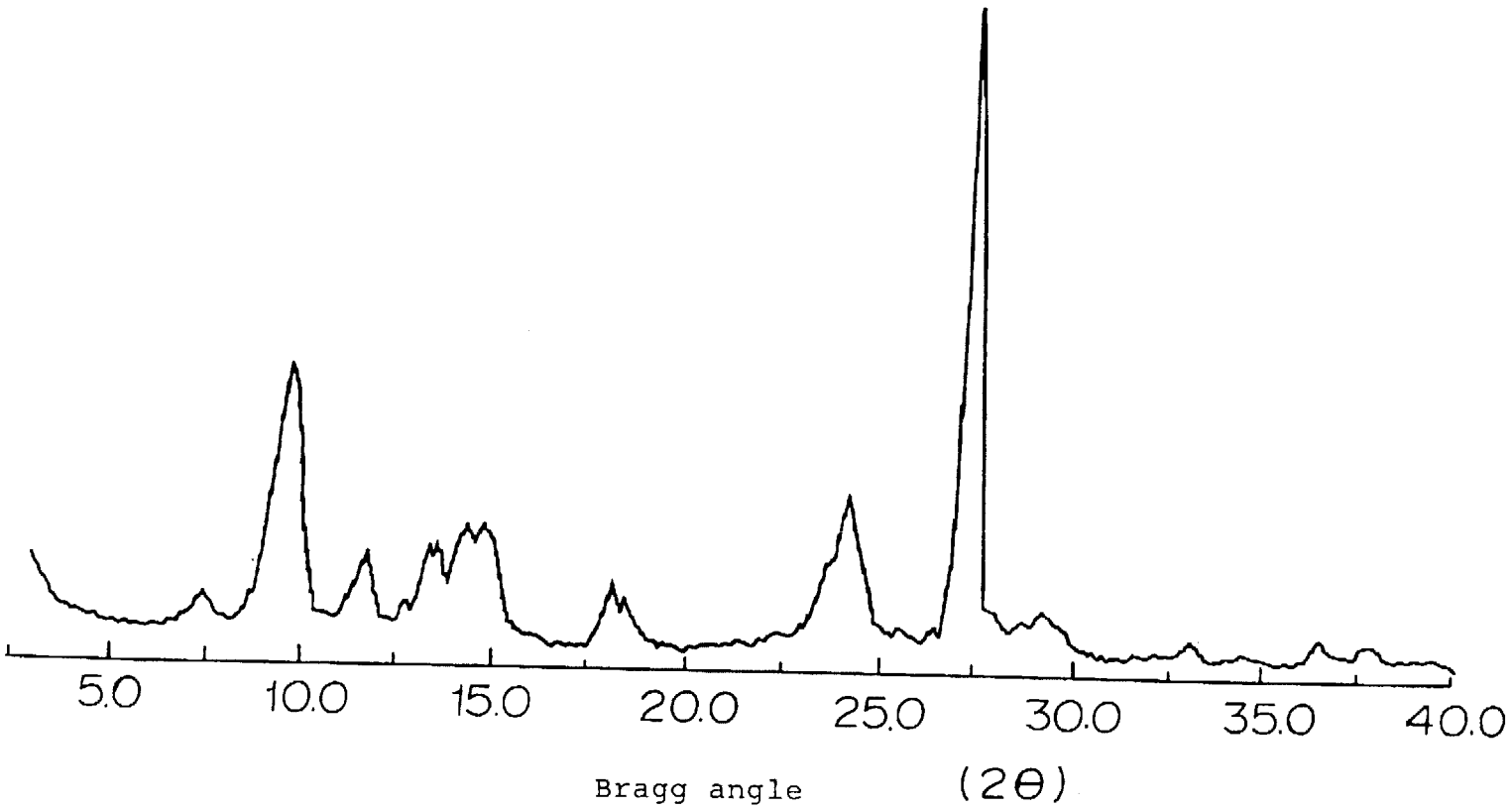
FIG. 1 is a powder X-ray diffraction spectrum of oxytitanium phthalocyanine used in Examples.

Now, the present invention will be described in detail with reference to the preferred embodiments.

The electrophotographic photoreceptor of the present invention comprises an electrically conductive substrate and at least a carrier generation layer and a carrier transport layer formed in the substrate usually in this order. As the electrically conductive substrate, a metal material such as aluminum, stainless steel, copper or nickel, or an insulation substrate such as a polyester film or paper provided on its surface with an electrically conductive layer of e.g. aluminum, copper, palladium, tin oxide or indium oxide, may, for example, be used.

A conventional barrier layer which is commonly used, may be provided between the electrically conductive substrate and the carrier generation layer.

The barrier layer may, for example, be an anodized aluminum oxide coating film, an inorganic layer of e.g.

aluminum oxide or aluminum hydroxide, or an organic layer of e.g. polyvinyl alcohol, casein, polyvinyl pyrrolidone, polyacrylic acid, a cellulose, gelatin, starch, polyurethane, polyimide or polyamide.

As the carrier generation material to be used for the carrier generation layer, any one of conventional carrier generation materials may be employed, including, for example, selenium and its alloy, an arsenic-selenium alloy, cadmium sulfide, zinc oxide and other inorganic photoconductive materials, various organic pigments and dyes such as phthalocyanine, azo dye, quinacridone, polycyclic quinone, a pyrylium salt, a thiapyrylium salt, indigo, thioindigo, anthanthrone, pyranthrone and cyanine. Among them, metal-free phthalocyanine, indium copper chloride, gallium chloride, a metal such as tin or oxytitanium, zinc or vanadium, or its oxide, a phthalocyanine having a chloride coordinated thereto, or an azo pigment such as a monoazo, bisazo, trisazo or polyazo pigment, is preferred. In the present invention, an azo pigment is particularly suitable.

The carrier generation layer contains such a carrier generation material and at least a polyester resin having a structure of the above formula (I).

In the formula (I), each of $R^1$ and $R^2$ is an alkylene group such as an ethylene group, a propylene group or a butylene group, which may have a substituent such as a halogen atom or an aryl group, preferably an ethylene group or a 1,2-propylene group.

Each of m and n is from 0 to 10, preferably from 0 to 3, provided that m and n are not simultaneously 0.

Each of $R^3$ and $R^4$ is a hydrogen atom; an alkyl group such as a methyl group, an ethyl group or a propyl group; or an aryl group such as a phenyl group or a naphthyl group, provided that the alkyl group and the aryl group may have a substituent such as an alkyl group or a halogen atom. Otherwise, $R^3$ and $R^4$ may together form a ring. Preferably, $R^3$ and $R^4$ are a methyl group, a phenyl group or together form a cyclohexane ring. Particularly, preferably, they are methyl groups.

Ar is an arylene group such as a phenylene group or a naphthalene group, which may have a substituent such as an alkyl group, preferably a phenylene group. Each of $Ar^1$ and Ar2 is a phenylene group which may have a substituent such as an alkyl group such as a methyl group or an ethyl group or an aryl group such as a phenyl group or a naphthyl group.

The unit of the formula (I) is preferably a unit of the following formula (I'):

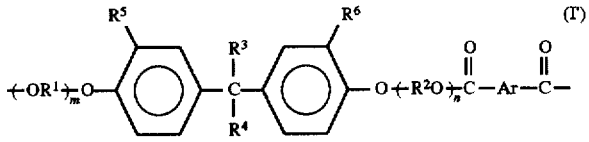

(I')

In the formula (I'), $R^1$, $R^2$, $R^3$, $R^4$, Ar, m and n are as defined above with respect to the formula (I). Like $R^3$ and $R^4$, each of $R^5$ and $R^6$ is a hydrogen atom; an alkyl group such as a methyl group, an ethyl group or a propyl group; or an aryl group such as a phenyl group or a naphthyl group, provided that the alkyl group and the aryl group may have a substituent such as an alkyl group or a halogen atom. Each of $R^5$ and R6 is preferably a hydrogen atom or a methyl group, particularly preferably a hydrogen atom.

To the polyester resin, other components may be copolymerized in an amount of e.g. at most 5 wt %, as the case requires. The polyester resin can be synthesized by a usual ester exchange reaction from the corresponding dihydric alcohol and dibasic carboxylate. In such a case, a small amount of a tri basic or higher basic carboxylate may be added for crosslinking. Otherwise, the polyester resin may be synthesized by various common methods such as direct condensation polymerization of a dihydric alcohol and a dibasic carboxylic acid.

Specific examples of the polyester resin of the present invention will be given below, but useful resins are not limited thereto.

Polyester (1)

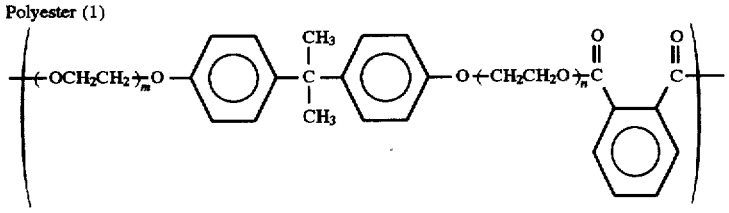

Each of m and n is from 0 to 2. Average value: $\bar{m}=\bar{n}=1$

Polyester (2)

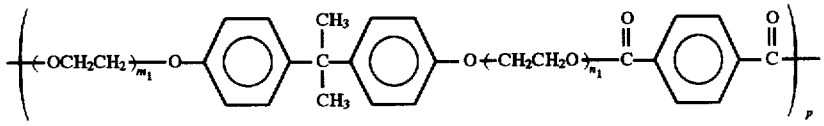

-continued

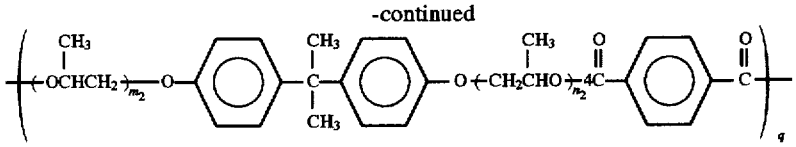

Each of $m_1$, $m_2$, $n_1$ and $n_2$ is from 0 to 2. Average value: $\overline{m}_1=\overline{m}_2=\overline{n}_1=\overline{n}_2=1$, p:q=1:2

Polyester (3)

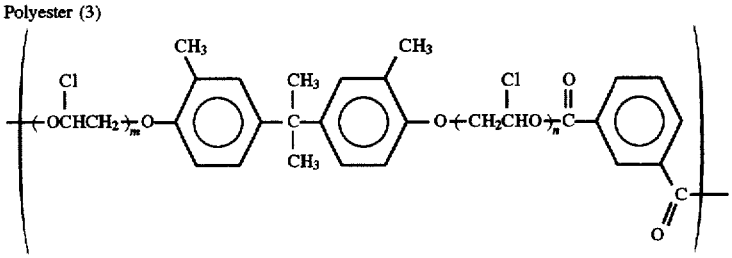

Each of m and n is from 0 to 6. Average value: $\overline{m}=\overline{n}=3$

Polyester (4)

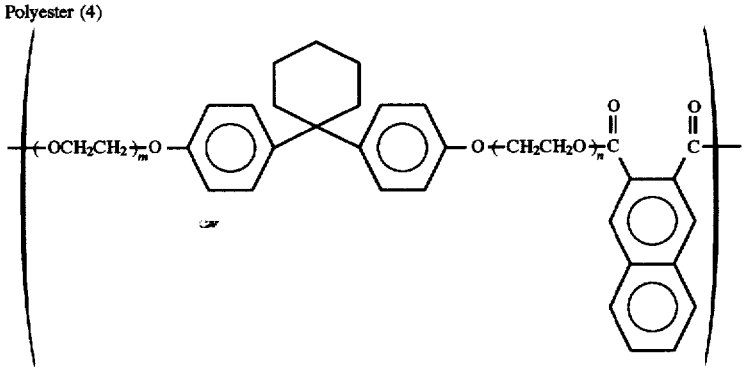

Each of m and n is from 0 to 8. Average value: $\overline{m}=\overline{n}=4$

Polyester (5)

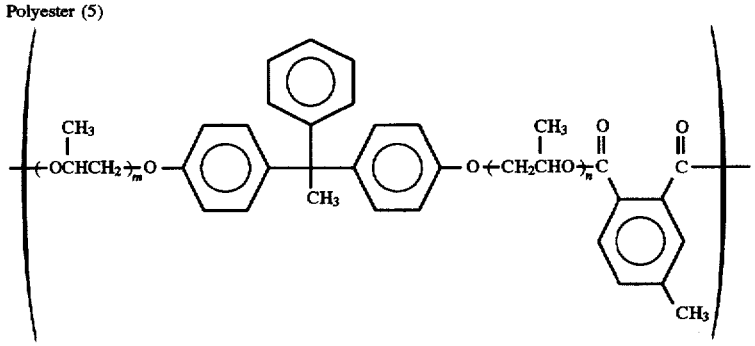

Each of m and n is from 0 to 10. Average value: $\overline{m}=\overline{n}=5$

In the carrier generation layer, together with such a polyester resin of the present invention, other resin such as other polyester resin, an acrylic resin, a polycarbonate resin or a polyvinyl acetal resin, may be used in combination. It is particularly preferred to use a polyvinyl acetal resin such as polyvinyl butyral in combination, as the dispersion stability will thereby be excellent. Such a polyvinyl acetal resin usually has a weight average molecular weight of from 10,000 to 500,000, preferably from 50,000 to 300,000.

In such a case, the blend ratio of the polyester resin to other resin is preferably from 0.1:1 to 1:0.05, more preferably from 0.5:1 to 1:0.2.

The above polyester resin preferably has a weight average molecular weight of 1,000 to 100,000, more preferably from 3,000 to 30,000.

The film thickness of the carrier generation layer is usually from 0.1 μm to 1 μm, preferably from 0.15 μm to 0.6 μm. The content of the carrier generation material used here, is usually within a range of from 20 to 300 parts by weight, preferably from 30 to 150 parts by weight per 100 parts by weight of the total amount including the binder resin.

The carrier transport material in the carrier transport layer may, for example, be a polymer compound such as polyvinyl carbazole, polyvinyl pyrene or polyacenaphthylene, or a low molecular compound such as various pyrazoline derivatives, hydrazone derivatives or stilbene derivatives.

Together with such a carrier transport material, a binder resin may be incorporated as the case requires. A preferred binder resin may, for example, be a vinyl polymer such as polymethyl methacrylate, polystyrene or polyvinyl chloride, or its copolymer, polycarbonate, polyester, polysulfone, polyether, polyketone, phenoxy, epoxy or silicone resin, or a partially crosslinked cured product thereof. The content of such a carrier transport material is usually within a range of from 30 to 200 parts by weight, preferably from 50 to 150 parts by weight, per 100 parts by weight of the binder resin.

Further, the carrier transport layer, may contain various additives such as an antioxidant, a sensitizer, etc., to improve the film forming property, flexibility, etc. The film thickness of the carrier transport layer is usually from 10 to 40 μm, preferably from 10 to 30 μm.

Now, the present invention will be described in further detail with reference to Examples and Comparative Examples. However, it should be understood that the present invention is by no means restricted to by specific Examples. Further, in the following Examples, "parts" means "parts by weight".

EXAMPLE 1

Ten parts of an azo compound having the following structure was added to 150 parts of 4-methoxy-4-methyl-2-pentanone, followed by pulverization and dispersion treatment by a sand grind mill.

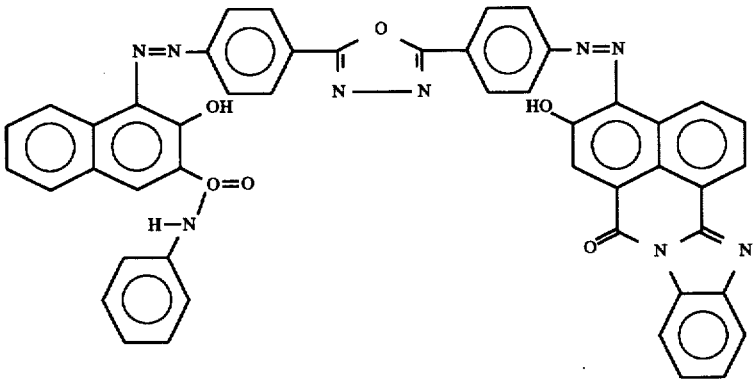

The pigment dispersion thus obtained was added to a solution mixture comprising 100 parts of a 5% dimethoxyethane solution of polyvinyl butyral (#6000-C, tradename, manufactured by Denka K. K.) and 100 parts of a 5% dimethoxyethane solution of the polyester resin (2) (weight average molecular weight: $7.8\times10^3$), to finally obtain a dispersion having a solid content concentration of 4.0%.

The above dispersion was coated on a PET film having aluminum vapor-deposited on its surface and dried to form a carrier generation layer so that the dried film thickness became 0.4 g/m$^2$ (about 0.4 μm).

On this carrier generation layer, a solution having 110 parts by an arylamine compound of the following structural formula:

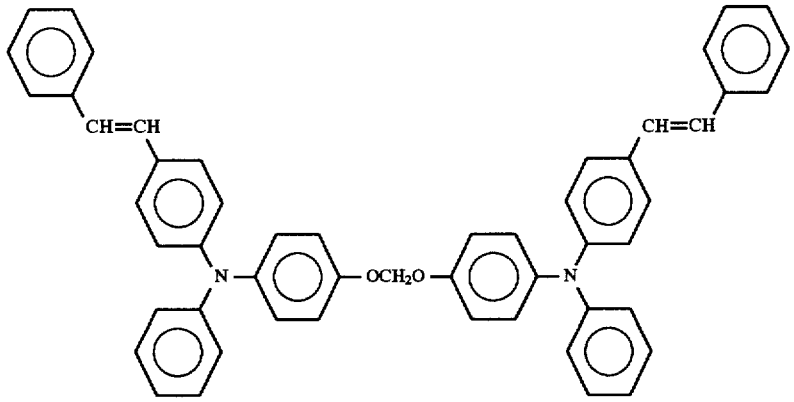

0.5 part of a cyano compound having the following structure:

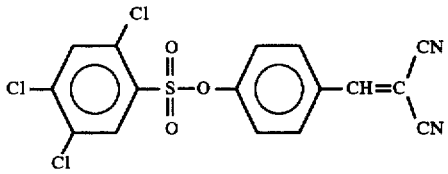

8 parts of 3,5-di-t-butyl-4-hydroxytoluene (BHT) of the following structure:

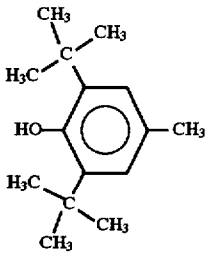

and 100 parts of a polycarbonate resin having the following repeating structure, dissolved in a solvent mixture of dioxane and tetrahydrofuran, was coated and dried to form a carrier transport layer so that the dried film thickness became 35 μm, to obtain a photoreceptor.

The photoreceptor thus obtained is designated as sample 1-A.

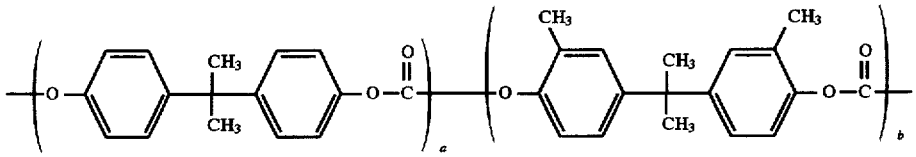

wherein a:b = 4:6

Photoreceptor sample 1-B was prepared in the same manner as for sample 1-A except that the polyester (1) (weight average molecular weight: $9.0\times10^3$) was used instead of the polyester (2) as the carrier generation layer.

COMPARATIVE EXAMPLE 1

Comparative samples 1-Y and 1-Z were prepared in the same manner as for sample 1-A, except that a phenoxy resin (PKHH, tradename, manufactured by Union Carbide and a known polyester (Bylon 200, manufactured by Toyobo Co., Ltd.) were used instead of the polyester (2) as the binder for the carrier generation layer.

Bylon 200

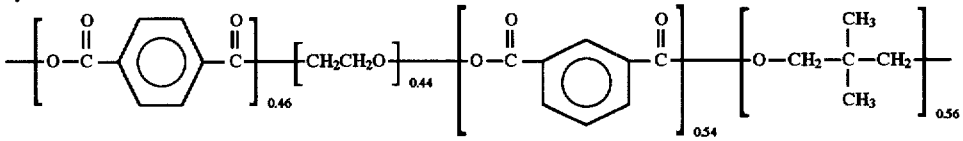

The properties of the photoreceptors prepared as described above, were measured as follows.

Firstly, in a dark place, corona discharge was carried out by corotoron so that a corona current flowing into the photoreceptor would be 50 μA, and a photoreceptor was passed therethrough at a constant speed (150 mm/sec) and electrically charged, whereby the charged voltage was measured to obtain an initial charged voltage (Vo). Then, white light of 5 lux was irradiated, whereby the exposure (E1/2) required for the drop of the surface potential of the photoreceptor to one half from the initial charged voltage, was obtained. Further, the charged voltage after irradiation with the white light of 5 lux for 10 seconds was measured to obtain the residual potential (Vr).

The results are shown in Table 1.

TABLE 1

| Sample | Binder used | Vo (v) | Vr (v) | E½ (lux · sec) |
|---|---|---|---|---|
| Sample 1-A | Polyester (2) | −1235 | −3 | 0.90 |
| Sample 1-B | Polyester (1) | −1198 | −5 | 0.98 |
| Comparative sample 1-Y | PKHH | −1205 | −4 | 1.03 |
| Comparative sample 1-Z | Bylon 200 | −1086 | −12 | 1.00 |

It is evident from Table 1 that each of the photoreceptors of the present invention exhibits excellent properties, whereas the photoreceptors using conventional binders, are inferior in the sensitivity or the residual potential.

EXAMPLE 2

Thirty parts of n-propanol was added to 1.6 parts of oxytitanium phthalocyanine showing a peak with the highest intensity at a Bragg angle (2θ±0.2°) of 27.3° in the powder X-ray diffraction spectrum by Cu-Kα rays as shown in FIG. 1, followed by pulverization and dispersion treatment for 6 hours by a sand grind mill. The obtained dispersion was added to a solution mixture comprising 8 parts of a 5% methanol solution of polyvinyl butyral (# 6000-C, tradename, manufactured by Denka K. K.) and 8 parts of a 5% methanol solution of the polyester resin (2) (weight average molecular weight: $7.8\times10^3$) and further diluted with methanol to finally obtain a dispersion having a solid content concentration of 3.0%.

Then, this dispersion was coated on an aluminum vapor-deposited side of an aluminum vapor-deposited polyester film by a bar coater to form a carrier generation layer so that the film thickness after drying became 0.4 μm. Then, on this carrier generation layer, a solution having 56 parts of a hydrazone compound of the formula:

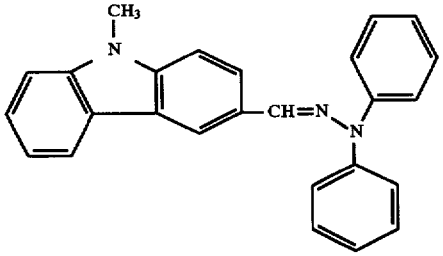

14 parts of a hydrazone compound of the formula:

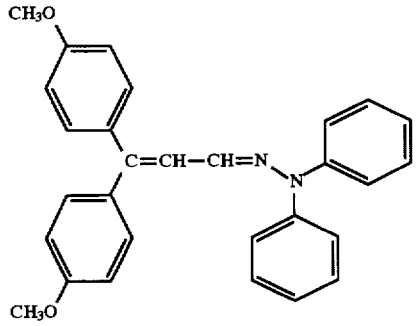

1.5 parts of a cyano compound of the formula:

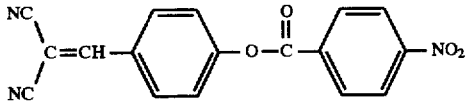

and 100 parts of a polycarbonate resin ("Novalex"® 7030A, manufactured by Mitsubishi Chemical Corporation) dissolved in 1,000 parts of 1,4-dioxane, was coated by a film applicator and dried to form a carrier transport layer so that the dried film thickness became 17 μm.

The photoreceptor thus obtained was designated as photoreceptor sample 2-A.

COMPARATIVE EXAMPLE 2

Comparative samples 2-Y and 2-Z were prepared in the same manner as for sample 2-A, except that a phenoxy resin (PKHH, tradename, manufactured by Union Carbide) and a known polyester (Bylon 200, manufactured by Toyobo Co., Ltd.) were used instead of the polyester (2) as the binder for the carrier generation layer.

The properties of the photoreceptors obtained as described above, were measured as followed.

Firstly, in a dark face, corona discharge was carried out by corotoron so that the corona current flowing into a photoreceptor would be 50 μA, and the photoreceptor was passed therethrough at a constant speed (150 mm/sec) and electrically charged, whereby the charged voltage was measured to obtain the initial charged voltage (Vo). Then, a 780 nm monochromatic light of 0.055 μW/cm² was irradiated, whereby the exposure (E1/2) required for the drop of the surface potential of the photoreceptor to one half from the initial potential was obtained. Further, the charged voltage after irradiation with the above 780 nm monochromatic light of 0.055 μW/cm² for 10 seconds, was measured to obtain a residual potential (Vr).

The results are shown in Table 2.

TABLE 2

| Sample | Binder used | Vo (v) | Vr (v) | E½ (μJ/cm²) |
|---|---|---|---|---|
| Sample 2-A | Polyester (2) | −1025 | −4 | 0.10 |
| Comparative sample 2-Y | PKHH | −1102 | −8 | 0.11 |
| Comparative sample 2-Z | Bylon 200 | −980 | −18 | 0.10 |

From the above table, it is evident that the photoreceptors employing the binders of the present invention exhibit excellent properties.

Then, to evaluate the dispersion states and the stability with time, of the dispersions used in the above Examples and Comparative Examples, the changes in their viscosities were measured. The results are shown in Table 3.

It is evident that the dispersions in which the polyester resins of the present invention were used, exhibit excellent dispersion and stability with time, whereas the dispersions in which conventional polyesters were used as the binders are inadequate in these properties.

TABLE 3

| Example | Dispersion | Binder used | Viscosity (centipoise) Initial | 60 days later |
|---|---|---|---|---|
| Example 1 | Dispersion of sample 1-A | Polyester (2) | 1.79 | 1.85 |
| Example 1 | Dispersion of sample 1-B | Polyester (1) | 1.72 | 1.83 |
| Comparative Example 1 | Dispersion of comparative sample 1-Y | PKHH | 1.62 | 1.70 |
| Comparative Example 1 | Despersion of comparative sample 1-Z | Bylon 200 | 1.94 | 2.41 |
| Example 2 | Dispersion of sample 2-A | Polyester (2) | 3.05 | 3.10 |
| Comparative Example 2 | Dispersion of comparative sample 2-Y | PKHH | 2.95 | 3.02 |
| Comparative Example 2 | Dispersion of comparative sample 2-Z | Bylon 200 | 3.25 | 3.82 |

As is evident from the foregoing results, the polyester resins of the present invention exhibit excellent dispersion and stability with time, and photoreceptors employing them can be regarded as photoreceptors excellent in electrical properties such as the sensitivity and the residual potential.

The electrophotographic photoreceptor of the present invention is prepared by using a novel polyester resin excellent in dispersion stability, as a binder polymer for the carrier generation layer, and it can be prepared industrially advantageously. Its electrical properties are at least equal to conventional products and provide remarkable effects for high sensitivity. Thus, it provides substantial industrial advantages.

We claim:

1. An electrophotographic photoreceptor comprising an electrically conductive substrate and at least a carrier generation layer and a carrier transport layer formed in that order on the substrate, wherein said carrier generation layer contains a polyester resin having a repeating structural unit of the following formula (I):

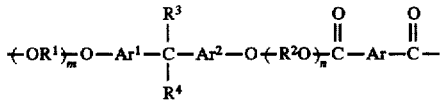

(I)

wherein each of $R^1$ and $R^2$ is an alkylene group which may have a substituent; each of $R^3$ and $R^4$ is a hydrogen atom, an alkyl group which may have a substituent or an aryl group which may have a substituent, or $R^3$ and $R^4$ may together form a ring; Ar is an arylene group which may have a substituent; each of $Ar^1$ and $Ar^2$ is a phenylene group which may have a substituent; and each of m and n is from 0 to 10, provided that m and n are not simultaneously 0.

2. The electrophotographic photoreceptor according to claim 1, wherein the formula (I) is represented by the following formula (I'):

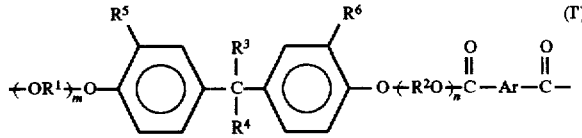

(I')

wherein $R^1$, $R^2$, $R^3$, $R^4$, Ar, m and n are as defined with respect to the formula (I), and each of $R^5$ and $R^6$ is a hydrogen atom, an alkyl group which may have a substituent or an aryl group which may have a substituent.

3. The electrophotographic photoreceptor according to claim 1, wherein Ar is a phenylene group which may have a substituent.

4. The electrophotographic photoreceptor according to claim 1, wherein each of $R^1$ and $R^2$ is an ethylene group or a 1,2-propylene group.

5. The electrophotographic photoreceptor according to claim 2, wherein each of $R^5$ and $R^6$ in the formula (I') is a hydrogen atom or a methyl group.

6. The electrophotographic photoreceptor according to claim 1, wherein each of m and n in the formula (I) is from 0 to 3.

7. The electrophotographic photoreceptor according to claim 1, wherein the carrier generation layer contains a polyvinyl acetal resin.

8. The electrophotographic photoreceptor according to claim 7, wherein the weight ratio of the polyvinyl acetal resin to the polyester resin of the formula (I) is from 0.05:1 to 1:0.1.

9. The electrophotographic photoreceptor according to claim 7, wherein the polyvinyl acetal is polyvinyl butyral.

10. The electrophotographic photoreceptor according to claim 1, wherein the carrier generation layer contains an azo pigment.

11. The electrophotographic photoreceptor according to claim 1, wherein the carrier generation layer contains oxytitanium phthalocyanine which shows a peak with the highest intensity at a Bragg angle (2θ±0.2°) of 27.3° in the X-ray diffraction spectrum by Cu-Kα rays.

* * * * *